United States Patent [19]

Operschall et al.

[11] Patent Number: 4,634,511

[45] Date of Patent: Jan. 6, 1987

[54] DEVICE FOR ELECTROPOLISHING THE INNER SURFACE OF HOLLOW CYLINDRICAL BODIES

[75] Inventors: Hermann Operschall, Lauf; Klaus-Alfred Steiner, Erlangen; Ludwig Voggenthaler, Regensburg, all of Fed. Rep. of Germany

[73] Assignee: Kraftwerk Union Aktiengesellschaft, Mülheim, Fed. Rep. of Germany

[21] Appl. No.: 681,107

[22] Filed: Dec. 12, 1984

[30] Foreign Application Priority Data

Dec. 14, 1983 [DE] Fed. Rep. of Germany ..... 3345278

[51] Int. Cl.[4] ..... C25D 17/00

[52] U.S. Cl. ..... 204/212

[58] Field of Search ..... 204/212

[56] References Cited

U.S. PATENT DOCUMENTS 4,001,094 1/1977 Jumer ..... 204/212
4,190,513 2/1980 Jumer ..... 204/224 R
4,304,654 12/1981 Norris ..... 204/212

FOREIGN PATENT DOCUMENTS 0074463 5/1982 European Pat. Off. ..... 204/212
3136187 4/1983 Fed. Rep. of Germany ..... 204/212

*Primary Examiner*—T. M. Tufariello
*Attorney, Agent, or Firm*—Herbert L. Lerner; Laurence A. Greenberg

[57] ABSTRACT

A device for electropolishing the inner surface of a hollow cylindrical body with at least one sponge electrode movable along the inner surface, as well as with devices for guiding the sponge electrode and for supplying the sponge electrode with electrolyte includes a chassis braced against the inner surface of the hollow cylindrical body and being movable along the axis of curvature of the hollow cylindrical body, the sponge electrode being carried by the chassis, being pressable against the inner surface of the hollow cylindrical body and being rotatable about the axis of curvature of the hollow cylindrical body.

23 Claims, 5 Drawing Figures

DEVICE FOR ELECTROPOLISHING THE INNER SURFACE OF HOLLOW CYLINDRICAL BODIES

The invention relates to a device for electropolishing the inner surface of hollow cylindrical bodies and, more particularly, to such a device with at least one sponge electrode movable along the inner surface, as well as with devices for guiding the sponge electrode and for supplying the sponge electrode with electrolyte.

From German Published Non-Prosecuted Application (DE-OS) No. 31 36 187, it has become known to decontaminate pipes of nuclear plants by providing that electrolyte liquid be flung against the inner wall of these pipes through nozzles by means of a high-pressure pump. The electrolyte liquid is supplied via a hose extending along the axis of the pipe. A wire which is arranged around the hose in the form of a helix serves as an electrode. It is a peculiarity of this method that considerable quantities of electrolyte liquid are required therefor.

It has already also been proposed heretofore to decontaminate metallic components of nuclear plants by electropolishing and to reciprocate a sponge-like electrode saturated with electrolyte liquid on the surface of the part to be decontaminated. In this device which should use the electrolyte rather sparingly, the problem remains unsolved, however, of how the working force wiping the sponge electrode along the surface of the workpiece can be protected against excessive radiation exposure.

It is accordingly an object of the invention to provide a device for electropolishing or decontaminating hollow cylindrical bodies, such as pipes, elbows and tanks without requiring excessive amounts of electrolyte and without subjecting the operating personnel to excessive radiation exposure. Long pipe sections, elbows as well as very large tanks should be capable of being decontaminated or electropolished thereby.

With the foregoing and other objects in view, there is provided, in accordance with the invention, a device for electropolishing the inner surface of a hollow cylindrical body with at least one sponge electrode movable along the inner surface, as well as with devices for guiding the sponge electrode and for supplying the sponge electrode with electrolyte, comprising a chassis braced against the inner surface of the hollow cylindrical body and being movable along the axis of curvature of the hollow cylindrical body, the sponge electrode being carried by the chassis, being pressable against the inner surface of the hollow cylindrical body and being rotatable about the axis of curvature of the hollow cylindrical body. As a result, uniform pressure the sponge electrode against the inside surface to be cleaned is assured even in the case of very long pipe sections, and the operator can remain at a very great distance from the contaminated inner surface of the hollow cylindrical body. At the same time, the consumption of electrolyte liquid can be kept within limits due to the use of a sponge electrode even in the decontamination of long pipe sections and very large tanks. This is of great importance in connection with the disposal of the electrolyte liquid.

In accordance with another feature of the invention, there is provided positioning drive means for rotating the respective sponge electrode with respect to the chassis about the axis of curvature of the hollow cylindrical body and about an axis of symmetry of the chassis extending parallel to the axis of curvature. As a consequence, the entire circumference of the hollow cylindrical body can be cleaned in all of the positions thereof relative to the direction of the force of gravity. Also, in this regard, no torques need be transmitted over great distance.

The electropolishing performance can be increased markedly in accordance with a further feature of the invention, by providing a plurality of the sponge electrodes carried by the chassis, the sponge electrodes being mutually offset by respectively equal pitch angles relative to one another in a plane oriented perpendicularly to the axis of symmetry of the chassis. The simultaneously electropolished surface area can be multiplied without having to use sponge electrodes with excessively large areas because these sponge electrodes would limit the use of the device only to hollow cylindrical bodies with specific, closely adjacent radii of curvature. Simultaneously, prerequisites are provided by this measure, in accordance with an additional particularly advantageous feature of the invention, that the sponge electrodes be turnable only slightly more than through their respective pitch angle about the axis of symmetry of the chassis. This in turn simplifies the construction of the positioning drive required therefor. It permits the use of relatively simple, corrosion-resistant hydraulic automatic positioning drives for limited rotation of the sponge electrodes about the axis of symmetry of the chassis over a limited angle. Thus, angles of rotation of 90° are sufficient for four sponge electrodes, and angles of rotation of 45° in the case of eight sponge electrodes. The latter could even be generated by a hydraulic piston acting on a lever.

Other features which are considered as characteristic for the invention are set forth in the appended claims.

Although the invention is illustrated and described herein as embodied in a device for electropolishing the inner surface of hollow cylindrical bodies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
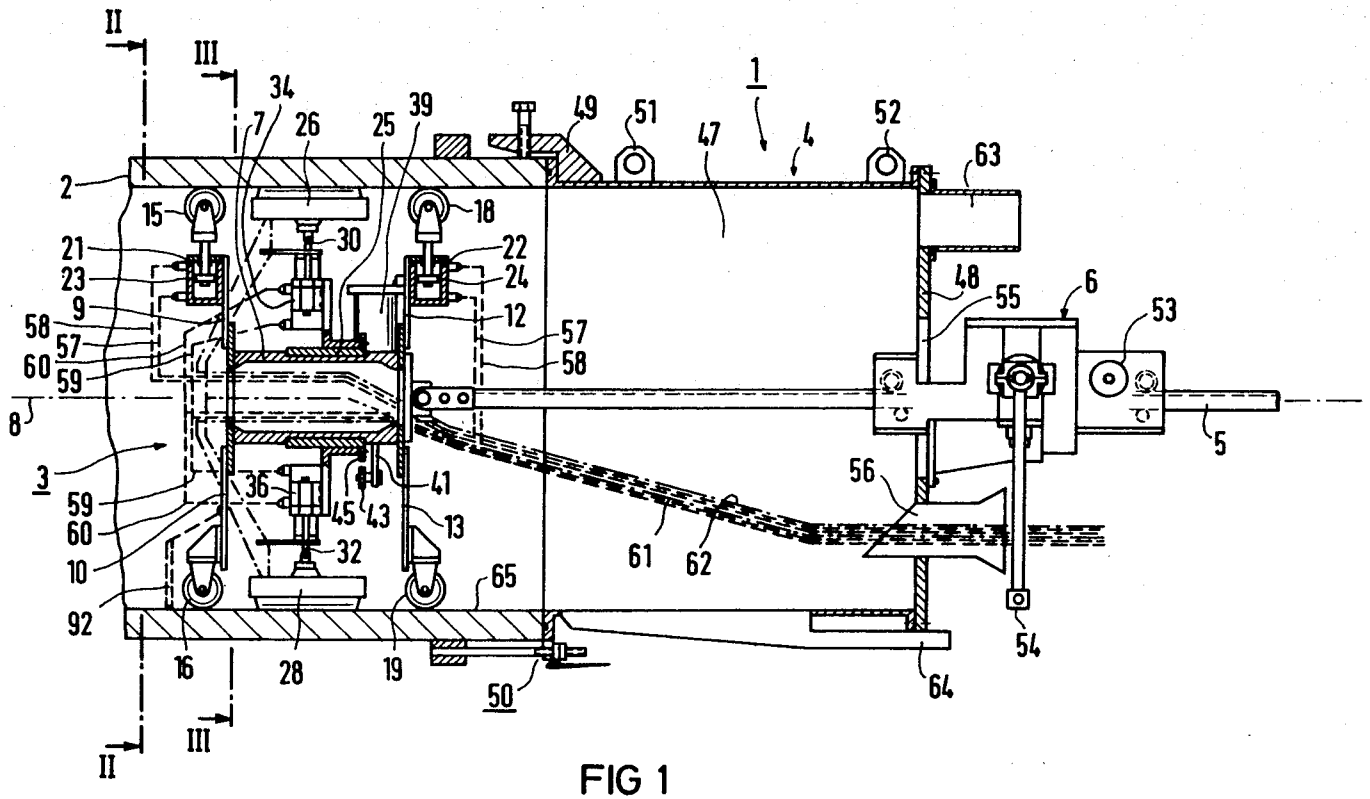
FIG. 1 is a longitudinal view of a device for electropolishing the inner surface of a pipe, the device being inserted into a pipe section together with an appertaining rerailing device and a feeding device.

Referring now to the drawing and first, particularly, the FIG. 1 thereof, there is shown diagrammatically a device for electropolishing according to the invention. It is formed of a chassis or undercarriage 3 which is insertable into a hollow cylindrical body 2 (a pipe nozzle or joint in the embodiment), a rerailing device 4 for the chassis 3 which is connectible to the hollow cylindrical body 2, a push rod 5 for the chassis 3 and a feeding device 6 for the push rod 5, the feeding device 6 being tiltably gimbal-supported on the rerailing device 4. The device 1 for electropolishing according to the invention also includes devices for supplying, discharging and processing electrolyte liquid, as well as a power supply, which are not otherwise illustrated in detail in the drawing.

Figure 2:
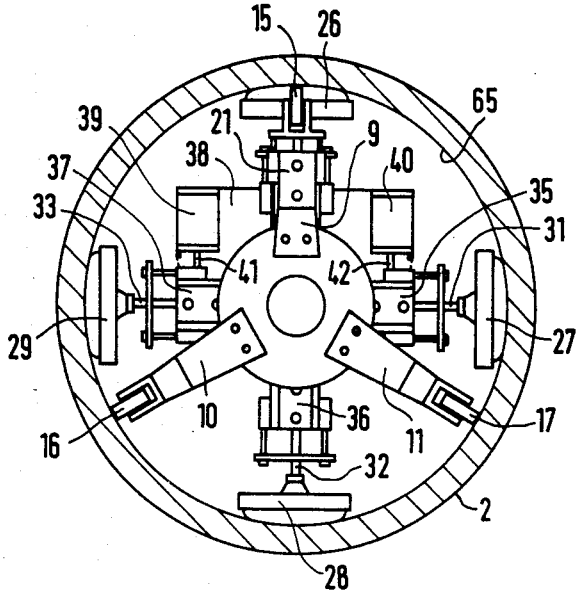
FIG. 2 is a cross-sectional view of FIG. 1 taken along the line II—II in the direction of arrows.

In FIG. 1, the chassis or undercarriage 3 is shown in a position wherein it has just been inserted by the feeding device 6 through the intermediary of the push rod 5, in this case a toothed rack, from the rerailing device 4 into the pipe joint or nozzle 2 shown in longitudinal sectional view which is to be electropolished. In FIG. 1, there is seen in conjunction with FIG. 2, which is a cross-sectional view taken along the line II—II in FIG. 1, that the chassis or undercarriage 3 so formed of a support cylinder 7 which is axially aligned with the hollow cylindrical body 2 which is to be cleaned, the support cylinder 7 being braced at both of its ends against the inside surface of the hollow cylindrical body 2 via three support legs 9, 10 and 11, as well as 12, 13 and 14, respectively, which are offset 120° relative to one another about the symmetry axis 8 of the support cylinder 7. The three support legs 9 to 11 and 12 to 14, respectively, are each provided with a running wheel 15, 16 and 17, as well as 18, 19 and 20, respectively. In order to adapt the support legs to different pipe sizes, always two (16 and 17, as well as 19 and 20, respectively) of the sets of three running wheels arranged on each side of the support cylinder 7 are threadedly fastenable to the respective support legs 10, 11, 13 and 14, as indicated in FIG. 1, at different radial distances from the support cylinder 7. In addition, the respective running wheel 15, 18 of the respective third support leg 9, 12 can be pressed by means of a respective pressure cylinder 21, 22, which can be acted upon from two sides, against the inner wall of the hollow cylindrical body. A ring 25 is rotatably mounted about the support cylinder 7 and has four sponge electrodes 26, 27, 28 and 29 fastened thereto. The sponge electrodes are coupled to the spring-loaded piston rods 30, 31 and 32 of respective working cylinders 34, 35, 36 and 37 which can be acted upon from one side and, via a piston rod of which, it can be pressed against the inner surface of the hollow cylindrical body 2 which is to be electropolished, and is liftable over the internals thereof.

Figure 3:
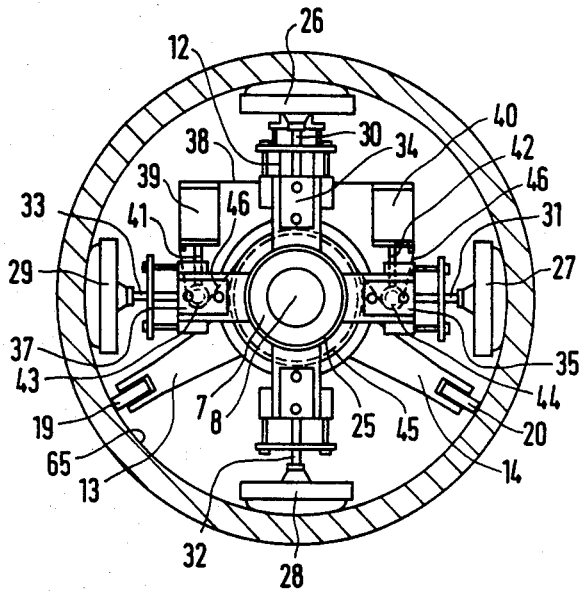
FIG. 3 is a cross-sectional view of FIG. 1 taken along the line III—III in the direction of the arrows.

A support plate 38 is installed on the support cylinder 7 of the chassis or undercarriage 3. The support plate 38 extends beyond the rotatable ring 25 on opposite sides. A respective hydraulic cylinder 39, 40, which can be acted upon on one side, is installed on the support plate 38 on mutually opposite sides of the rotatable ring 35. A respective small sprocket wheel 43, 44 is supported on the piston rods 41, 42 of these two hydraulic cylinders. The ring 25 which is rotatable about the support cylinder 7 of the chassis 3 also carries sprocket-like teeth 45 at the outer circumference thereof. The two ends of an endless chain 46 are fastened to opposite sides of the rotatable ring 25. As is shown in FIG. 3, this chain 46 is conducted first about the one sprocket wheel 43 which is rotatably supported on the piston rod 41, then around half the circumference of the rotatable ring 25 over its sprocket-like teeth 45 and then on the other side of the rotatable ring 25 about the sprocket wheel 44 on the piston rod 42 of the hydraulic cylinder 40 located thereat.

The rerailing device 4 is formed, as shown in FIG. 1, mainly of a tube 47 having the same inner diameter as that of the pipe joint or nozzle 2 to be electropolished. This tube 47 of the rerailing device is closed by a flanged-on cover 48 on the side thereof facing away from the pipe nozzle 2 to be electropolished. On its open side facing the pipe nozzle 2 to be electropolished, the rerailing device is provided with angular guides 49 (only one of which is shown) and clamping devices 50 (only one of which is shown). In addition, the tube of the rerailing device carries two support eyes 51, 52. This tube 47 of the rerailing device 4 is of such length that it can completely accommodate the chassis 3 after the completion of the work. The feeding device 6 is suspended in gimbals on the cover 48 of the rerailing device 4, in a manner not shown in detail in the drawings, centered with respect to the cover 48. The feeding device 6 has an electric motor 53, having a non-illustrated pinion which meshes with a rack 5 extending through the feeding device 6 approximately axially to the tube 47 of the rerailing device 4. The pinion is disengageable. The rack 5 is manually movable by a handle 54. The rack 5 can be fastened articulatingly to the support cylinder 7 of the chassis 3. On the cover 48 of the rerailing device 4, there are further provided, in addition to the feedthrough 55 for the rack 5, a feedthrough 56 for various hydraulic hoses 57, 58, 59 and 60 as well as for a feed hose 60 and a discharge hose 62 for the electrolyte liquid. Furthermore, a suction nozzle 63 for aerosol is attached. Finally, a discharge nozzle 64 for electrolyte liquid that has run out is attached at the lower end of the tube 47 of the rerailing device 4.

Figure 4:
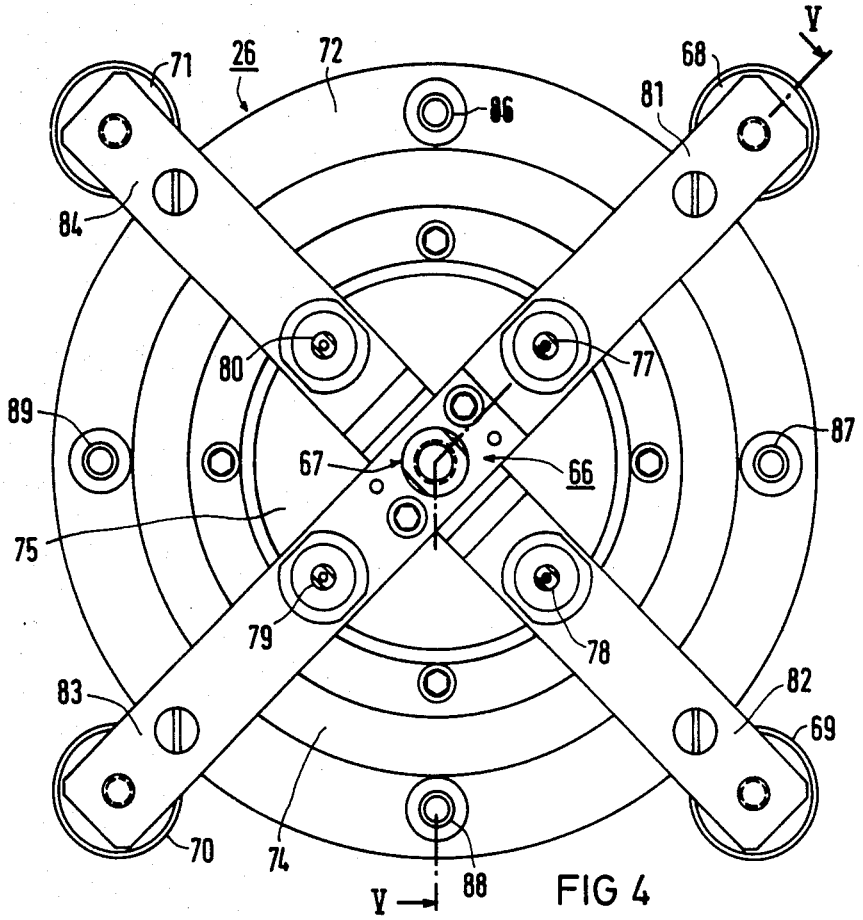
FIG. 4 is an enlarged fragmentary top plan view of FIG. 1 showing a sponge electrode.
Figure 5:
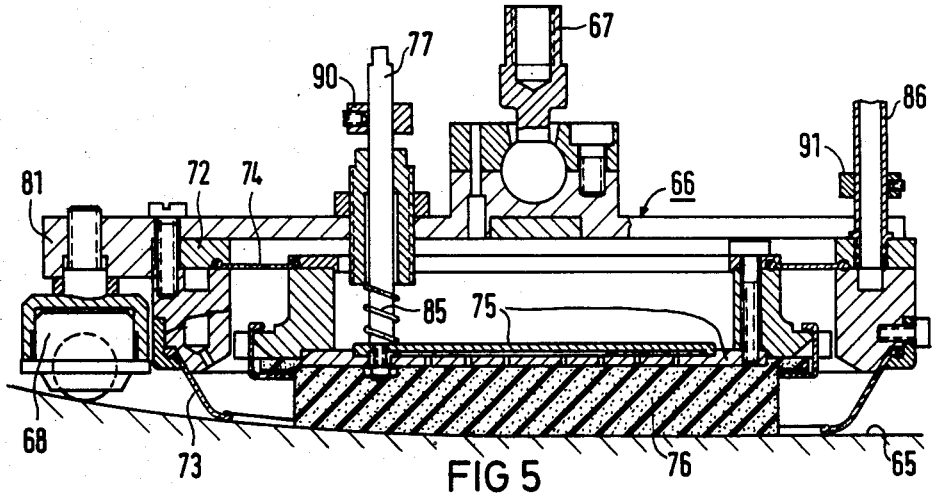
FIG. 5 is a cross-sectional view of FIG. 1 taken along the line V—V in the direction of the arrows.

FIG. 4 is a top plan view of the sponge electrodes 26, 27, 28 and 29. It is apparent therefrom that the sponge electrode 26 which has the shape of a circular disc in the top view, is bolted to a cross-shaped guide frame 66 by the side thereof facing away from the surface of the inner wall 65 of the pipe nozzle 2 to be cleaned. A the center of the cross-shaped guide frame 66, there is mounted, as illustrated in the cross-sectional view of FIG. 5, a ball joint 67 which is threadedly fastenable to the piston rod 30, 31, 32, 33 of respective work cylinders 34, 35, 36 and 37 fastened to the rotatable wing 25 and able to be acted upon from both sides. TO the four ends of the guide frame 66, there is fastened a respective ball roller cage 68, 69, 70, 71. When the sponge electrode 26 is in contact with the inner wall 65 of a hollow-cylindrical body 2, the ball roller cages make contact with the inner wall of this hollow-cylindrical body 2. The housing ring 72 of the sponge electrode 26 is bolted directly to the cross-shaped guide frame 66, and carries a ring-shaped seal 73 on the side thereof facing the inner wall 65 of the hollow-cylindrical body 2 to be polished. On the side of the housing ring 72 facing the guide frame 66, the outer rim of another annular rubber seal 74 is clamped. The inner rim of the latter is sealingly clamped to the edge of a cup-shaped pressure plate 75. This cup-shaped pressure plate 75 carries a sponge body 76 on the side thereof facing the surface to be electropolished. The cup-shaped pressure plate 75 is held by the washer-shaped rubber seal 74 in centered relationship to the housing ring 72. It is provided with four electrolyte feed-line nozzles 77, 78, 79 and 80 which extend through each of the four arms 81, 82, 83 and 84, respectively, of the cross-shaped guide frame 66 and movable in longitudinal direction. Over each of these four electrolyte feed-line nozzles 77, 78, 79 and 80, there is disposed a respective compression spring 85 (only one of which is shown), which is braced on the one side thereof against the guide frame 66 on the other side thereof against the cup-shaped pressure plate 75 and, accordingly pushes the latter against the inner wall 65 to be polished. The electrolyte feed-line nozzles 77, 78, 79 and 80 extend through the bottom region of the cup-shaped pressure plate 75 into the sponge body 76. The housing ring 72 of the sponge electrode 26, which is bolted to the guide frame 66, carries four electrolyte suction-line nozzles 86, 87, 88 and 89 which, in the housing ring of the sponge electrode, terminate in the space sealed off by the two angular seals 73 and 74.

If a hollow cylindrical body 2, such as a pipe section or pipe nozzle or joint, for example, it to be electropolished or decontaminated by electropolishing, the device 1 according to the invention i. e. the rerailing device 4 with the chassis or undercarriage 3 located in the rerailing device and the feed device 6 linked in gimbals to the cover 48 of the rerailing device, can be transported for the electropolishing by means of the supporting eyes 51, 52 by a crane in front of the pipe nozzle 2 to be electropolished. There, the rerailing device 4 is centered at the pipe nozzle 2 to be electropolished by means of the angular guides 49 and clamping means 50 and brought to a stop. A special advantage of the device according to the invention thereby becomes effective already because a large part of the radioactive radiation emanating from the pipe nozzle to be decontaminated is shielded by putting on the rerailing device 4. Then, the hoses 61 and 62 for electrolyte supply and electrolyte section or discharge, extending out of the cover 48 of the rerailing device, as well as the hydraulic hoses 57, 58, 59 and 60 for applying pressure to the running wheels 15 to 20 of the chassis 3, as well as the work cylinders 34, 35, 36 and 37 for applying pressure to the sponge electrodes 26, 27, 28, 29 can be connected to the supply devices, otherwise not shown in detail in the drawings.

The chassis 3 with the sponge electrodes 26, 27, 28 and 29 can then be inserted into the pipe nozzle or joint 2 to be electropolished, through the intermediary of an electric motor 53 or also manually through the handle 54, by axial adjustment of the rack 5 in the feeding device 6. The instant the sponge electrodes 26, 27, 28 and 29 are located in the interior of the pipe nozzle, they can be pressed against the inner surface of the pipe nozzle through the intermediary of the piston rods 30, 31, 32 and 33 of the work cylinders 34, 35, 36 and 37. Because the piston rods are fastened in a ball joint 67 of the sponge electodes, flush contact of the sponge electrodes at the inner surface of the hollow cylindrical body is achieved also if the chassis 3 is not centered in the axis of curvature of the hollow cylindrical body or if the radius of curvature thereof varies in cicumferential direction. The respective work cylinder 34, 35, 36 and 37 can press the individual sponge electrode against the inner surface 65 of the hollow-cylindrical body only so far that the rollers of the ball roller cages 68, 69, 70 and 71 make contact with the inner surface. In this position, however, the sponge body 76 of the sponge electrode 26 already makes contact with the inner surface and is forced or pushed back somewhat in direction towards the guide frame 66 by the inner surface against the force of the compression springs 85 placed over the electrolyte feed-line nozzles 77, 78, 79 and 80.

If the electrolyte supply is turned on, the electrolyte liquid wets the sponge body 76 and connects the latter conductively to the cup-shaped pressure plate 75. The latter, however, is conductively connected in turn again to the respective electrolyte feed-line nozzle 77, 78, 79, 80 which is in contact with the negative pole of the nonillustrated power supply via a terminal 90. The removed surface material is absorbed in the sponge body 76. The excess electrolyte liquid running out of the sponge body remains in the cavity which is defined by the workpiece inner wall 65 to be electropolished, the annular seal 73 resting against the latter, and the washer shaped rubber seal 74 between the housing ring 42 and the rim of the cup-shaped pressure plate 75. From this space, the excess electrolyte liquid is sucked back into the processing device via the electrolyte suction-line nozzles 86, 87, 88 and 89 and the discharge hose 62 connected thereto. The suction pressure can thereby be adjusted in such a manner that air is also sucked-in under the annular seal 73 engaging the inner wall to be electropolished. Electrolyte liquid is thereby slidably prevented from escaping in appreciable amounts. The sucked-away electrolyte/air mixture is then separated in a processing device in an otherwise nonillustrated manner.

During the continuous, gradual advance of the chassis 3 into the pipe nozzle 2 to be cleaned by means of the feeding device 6, the rotatable ring 25 with the sponge electrodes 26 to 29 arranged at its circumference is simultaneously turned back and forth with uniform speed about the support cylinder 7 of the chassis 3. The turning is effected through a somewhat larger angle than the pitch angle between the sponge electrodes 26, 27, 28 and 29. In the case of the invention herein, with four sponge electrodes offset 90 ° relative to one another, the rotatable ring is turned back and forth through an angle of somewhat more than 90°. For this purpose, hydraulic liquid is alternatingly forced into the one and later into the other of the two hydraulic cylinders 39 and 40. As a result, the piston rod 41, 42 of the hydraulic cylinder, into which hydraulic liquid is just being forced, is pushed out of the sprocket wheel 43, 44 located at this piston rod extends or elongates the chain 46 on this side of the rotatable ring 25. A consequence of this, in turn, is that the chain is shortened on the opposite side of the rotatable ring, entrainingly turns the rotatable ring 25 and pushes the piston into the hydraulic cylinder there via the sprocket wheel located there, and forces the hydraulic liquid out of this hydraulic cylinder. The speed of rotation of the sponge electrodes 26, 27, 28 and 29 about the support cylinder 7 of the chassis 3 can be adjusted exactly merely by varying the cross section in one of the two hydraulic lines via a non-illustrated valve.

If the electrolyte liquid is not sucked away intentionally or due to a defect, the electrolyte liquid leaving the sponge body 76 and running out under the annular seal 73 of the sponge electrodes 26 collects at the lower end of the pipe nozzle 2 to be decontaminated. It can be drawn off from there via the discharge nozzle 64 for the electrolyte liquid at the tube 47 of the rerailing device 4. In such a case, it is advisable for a pipe plug or a liquid barrier to be placed ahead of the hollow cylindrical body to be electropolished and behind the region to be electropolished. Such a liquid barrier 93, which is segment-shaped and is fastened to the chassis 3, is indicated by broken lines in FIG. 1. In the event of a failure of the electric motor drive 53 of the feeding device 6, the pinion can be disengaged or decoupled in a manner otherwise not shown in detail in the drawing, and the rack can be moved back and forth either by turning the pinion by means of the handle 54 or via a non-illustrated ratchet coupled to the handle which acts directly on the rack, together with the chassis 3.

The device of the instant application can also be used for very large closed vessels. In this case, the rerailing device must be dispensed with, and the chassis with the support leg rollers, support cylinder and sponge electrodes must be assembled in the pressure vessel after these parts have been introduced through the manhole. The feed of this device is then advantageously performed manually by means of a push rod extending out of the manhole.

The foregoing is a description corresponding in substance to German Application No. P 33 45 278.4, dated Dec. 14, 1983, the International priority of which is being claimed for the instant application, and which is hereby made part of this application. Any material discrepancies between the foregoing specification and the aforementioned corresponding German application are to be resolved in favor of the latter.

We claim:

1. Device for electropolishing the inner surface of a hollow cylindrical body with at least one sponge movable along the inner surface, as well as with devices for guiding the sponge and for supplying the sponge with electrolyte, comprising a chassis braced against the inner surface of the hollow cylindrical body and being movable along the axis of curvature of the hollow cylindrical body, a rigid housing for each of the sponges, respectively, and respective support elements supporting said rigid housing on the hollow cylindrical body, an annular seal surrounding the respective sponge, said annular seal having an inner and an outer peripheral edge and being in engagement at one of its edges with said rigid housing and at the other of its edges with the inner surface of the hollow cylindrical body, the sponge being carried by said chassis, being pressible against the inner surface of the hollow cylindrical body and being rotatable about the axis of curvature of the hollow cylindrical body, an upper seal connected to a pressure plate for pressing the respective sponge against the inner surface of the hollow cylindrical body, said upper seal together with the inner surface of the hollow cylindrical body and said annular seal located thereat forming a sealing system for a spatial region of said rigid housing wherein the respective sponge is located, a suction line for electrolyte connected to said spatial region of said rigid housing wherein said sponge is located.

2. Device according to claim 1, including positioning drive means for rotating the respective sponge with respect to said chassis about the axis of curvature of the hollow cylindrical body and about an axis of symmetry of the chassis extending parallel to the axis of curvature.

3. Device according to claim 2, comprising a plurality of the sponges carried by the chassis, the sponge being mutually offset by respectively equal pitch angles relative to one another in a plane oriented perpendicularly to the axis of symmetry of said chassis.

4. Device according to claim 3 wherein the sponges are turnable only slightly more than through their respective pitch angle about the axis of symmetry of said chassis.

5. Device according to claim 1, including a respective positioning member connected to each of the sponges respectively, for pressing the sponges against the inner surface of the hollow cylindrical body.

6. Device according to claim 5, wherein the respective positioning member comprises an hydraulic cylinder.

7. Device according to claim 5, including spring means by which the sponges are pressed by the respective positioning members against the inner surface of the hollow cylindrical body.

8. Device according to claim 1, wherein a respective sponge is disposed in said rigid housing, and including a pressure plate for pressing the respective sponge against the inner surface of the hollow cylindrical body.

9. Device according to claim 8, wherein said pressure plate is spring-loaded.

10. Device according to claim 8, including a supply line for electrolyte extending through and connected to said pressure plate.

11. Device according to claim 1, wherein said suction line has an underpressure therein such that air is always also sucked under said annular seal surrounding said sponge body and engaging the inner wall of the hollow cylindrical body.

12. Device according to claim 1, including a respective positioning member connected to each of the sponges, respectively, for pressing the sponges against the inner surface of the hollow cylindrical body, and a respective housing for each of the sponges, said positioning member, respectively, centrically engaging a respective housing through the intermediary of a ball joint.

13. Device according to claim 1, wherein said support elements are formed as roller cages.

14. Device according to claim 1, including a ring holding the sponge electrodes on said chassis, said ring being rotatable about an axis of symmetry of said chassis.

15. Device according to claim 1, wherein a plurality of the sponges are carried by the chassis, the sponges being mutually offset by respectively equal pitch angles relative to one another in a plane oriented perpendicularly to an axis of symmetry of said chassis, and including at least one work piston displaceable in a work cylinder by means of a pressurized medium, the respective sponges being adjustable about at least one pitch angle by said one work piston.

16. Device according to claim 1, including a positioning drive disposed outside the hollow cylindrical body for rotating a respective sponge relative to said chassis, the respective sponge being adjustable by said positioning drive through the intermediary of a push rod along the length of said push rod.

17. Device according to claim 1, including respective elements for axially moving the chassis relative thereto into frictional engagement with the inner surface of the hollow cylindrical body.

18. Device according to claim 1, wherein said chassis carries, on a front side thereof, as viewed in direction of feed thereof, a bulkhead liquid-tightly closing off a lower part of the hollow cylindrical body.

19. Device according to claim 22, wherein said bulkhead is clampable in the hollow cylindrical body separately from said chassis.

20. Device according to claim 1, wherein the hollow cylindrical body is a pipe, and including a tubular rerailing device connectible at a matching end thereof to a pipe stub of the respective pipe, said tubular rerailing device containing said chassis and being partially closed at the end thereof facing away from the respective pipe.

21. Device according to claim 20, wherein said rerailing device has a discharge nozzle for discharging excess electrolyte.

22. Device according to claim 20, wherein a feeding device for said chassis is fastenable to said rerailing device.

23. Device according to claim 22, wherein said feeding device is mounted in gimbals for travelling through pipe bends on said rerailing device, and a toothed rack is mounted in gimbals on said chassis.

* * * * *